US008932078B1

(12) United States Patent
Martin et al.

(10) Patent No.: US 8,932,078 B1
(45) Date of Patent: Jan. 13, 2015

(54) APPARATUS, METHODS, AND SYSTEMS FOR RETAINING A CABLE

(75) Inventors: John Martin, Danville, CA (US); Adolpho Gonzalez, Fresno, CA (US)

(73) Assignee: Juniper Networks, Inc., Sunnyvale, CA (US)

( * ) Notice: Subject to any disclaimer, the term of this patent is extended or adjusted under 35 U.S.C. 154(b) by 139 days.

(21) Appl. No.: 13/617,014

(22) Filed: Sep. 14, 2012

(51) Int. Cl.
*H01R 13/74* (2006.01)

(52) U.S. Cl.
USPC ..... 439/574

(58) Field of Classification Search
USPC ..... 439/574, 492–495, 329, 607.01, 497, 439/620.01
See application file for complete search history.

(56) References Cited

U.S. PATENT DOCUMENTS

| | | | | | |
|---|---|---|---|---|---|
| 3,743,748 | A * | 7/1973 | Reeder | 174/75 C |
| 4,634,195 | A * | 1/1987 | Shoemaker | 439/493 |
| 4,679,868 | A * | 7/1987 | Hasircoglu | 439/495 |
| 6,007,359 | A * | 12/1999 | Kosmala | 439/329 |
| 7,300,303 | B2 * | 11/2007 | Kirkpatrick et al. | 439/492 |
| 8,608,504 | B2 * | 12/2013 | Tseng | 439/497 |
| 2007/0099444 | A1 * | 5/2007 | Backeralk et al. | 439/67 |
| 2007/0232127 | A1 * | 10/2007 | Lin | 439/492 |
| 2009/0280688 | A1 * | 11/2009 | Kawada et al. | 439/620.01 |
| 2010/0041273 | A1 * | 2/2010 | Scherer et al. | 439/607.01 |

* cited by examiner

*Primary Examiner* — Jean F Duverne
(74) *Attorney, Agent, or Firm* — Cooley LLP

(57) ABSTRACT

Apparatus, methods, and systems for coupling a cable to a printed circuit board are described herein. In some embodiments, a portion of a cable clamp is configured to be crimped about a cable having an inner conductor and an outer conductor, such as a coaxial cable. The cable clamp can have a projection configured to be inserted into an opening of a printed circuit board. The cable clamp can be configured to be fixedly coupled, for example, soldered, to the printed circuit board.

17 Claims, 9 Drawing Sheets

APPARATUS, METHODS, AND SYSTEMS FOR RETAINING A CABLE

BACKGROUND

The embodiments described herein relate to apparatus, methods, and systems for retaining a cable, such as a cable having an inner conductor and an outer conductor. The inner conductor of such cables is generally surrounded by a dielectric material. The dielectric material is typically surrounded by the outer conductor, for example, a conducting braid. More specifically, some embodiments described herein are suitable for coupling, to a printed circuit board, a coaxial cable operable to transmit high- and/or radio-frequency signals.

Known methods for coupling cables to printed circuit boards include using connectors, such as a U.FL connector. Such connectors, however, typically induce discontinuities in the signal path. For example, such connectors are typically mounted at a right-angle to the printed circuit board. Such signal path discontinuities can compromise the high-frequency performance of such connectors. U.FL connectors, for example, may not be suitable for signals exceeding 3 GHz.

Alternatively, cables can be soldered directly to printed circuit boards. In the case of a radio assembly the cable becomes part of the assembly for calibration purposes. Such cables are generally prepared for shipping and/or use by cutting the cable such that a portion of the dielectric extends beyond the outer conductor, and a portion of the inner conductor extends beyond the dielectric material. Before use, the inner conductor and/or the outer conductor can be dipped in solder to prevent fraying. Traditionally, an axial length of the dielectric material provides electrical insulation between the inner conductor and the outer conductor. Without an axial length of dielectric, the solder used to prevent fraying could electrically couple the outer conductor to the inner conductor. Having a portion of dielectric material extending axially beyond the outer conductor, however, can cause series inductance and/or shunt capacitance, which can decrease high-frequency performance of the cable. A need therefore exists for apparatus, methods, and systems for retaining a coaxial cable on a printed circuit board suitable for high-frequency applications.

SUMMARY

Apparatus, methods, and systems for coupling a cable to a printed circuit board are described herein. In some embodiments, a portion of a cable clamp is configured to be crimped about a cable having an inner conductor and an outer conductor, such as a coaxial cable. The cable clamp can have a projection configured to be inserted into an opening of a printed circuit board. The cable clamp can be configured to be fixedly coupled, for example, soldered, to the printed circuit board.

DETAILED DESCRIPTION

Apparatus, methods, and systems for coupling a cable having an inner conductor and an outer conductor, such as a coaxial cable, to a printed circuit board are described herein. In some embodiments, a first portion of a cable clamp can be configured to be crimped about the cable, for example, the first portion of the cable clamp can be configured to be crimped about an end portion of a coaxial cable. The cable clamp can have a second portion, which can be configured to define a projection. The projection can be configured to be inserted into an opening of the printed circuit board. The cable clamp can be configured to be fixedly coupled, for example, soldered, to the printed circuit board.

A method of coupling a cable to a printed circuit board can include crimping a cable clamp about a cable. For example, a first portion of the cable clamp can be crimped about an end portion of a coaxial cable. A second portion of the cable clamp, such as a projection, can be inserted into an opening of the printed circuit board. The cable clamp can be fixedly coupled, for example, soldered, to the printed circuit board after the protrusion is inserted into the opening.

An assembly can include a coaxial cable, a printed circuit board, and a cable clamp. A first portion of the cable clamp can be crimped about a portion of the cable, such as an end portion. A second portion of the cable clamp can be disposed within an opening of the printed circuit board. The cable clamp can be fixedly coupled, for example, soldered, to the printed circuit board.

Figure 1:
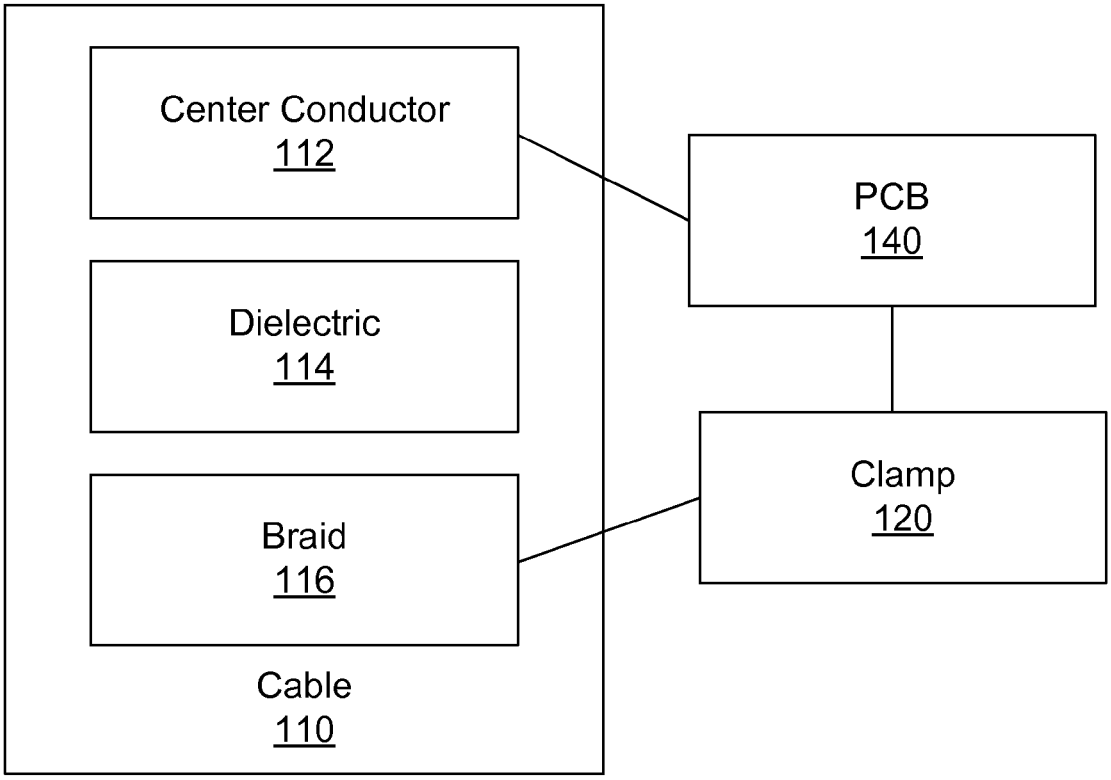
FIG. 1 is a schematic diagram of a cable, a clamp, and a printed circuit board, according to an embodiment.

FIG. 1 is a schematic diagram of a cable 110, a clamp 120, and a printed circuit board ("PCB") 140, according to an embodiment. The cable 110 can be coupled to the PCB 140 and the clamp 120. The clamp 120 can also be coupled to the PCB 140.

The cable 110 can be any cable having an inner conductor surrounded by an outer conductor, such as a coaxial cable, a triaxial cable, or a twinaxial cable. The cable 110 can include an inner conductor 112, which can be a solid or multi-stranded wire constructed of, for example, copper, silver, gold, nickel, steel, aluminum, tin, any other suitable conductive material, and/or any suitable alloy or combination of suitable materials. The inner conductor 112 can be surrounded by a dielectric 114. The dielectric 114 can be a solid or foamed material with suitable resistance and polarizability. For example, the dielectric can be constructed of fluorinated ethylene propylene, polytetraflouroethylene, any other suitable fluoropolymer, polyethylene, nylon, or any other suitable polymer, glass, porcelain, ceramic, and/or any other suitable material or combination of materials. The dielectric 114 can be surrounded by an outer conductor 116. The outer conductor 116 can be a braided and/or woven cylinder of aluminum, copper, steel, silver, gold, tin, any other suitable conductive material, and/or any suitable alloy or combination of suitable materials. In other embodiments, the outer conductor 116 can be a conductive foil, sheet, membrane, and/or tube. In some embodiments, the cable 110 can include a sheath (not shown in FIG. 1), which can surround the outer conductor 116. The sheath can protect, or reduce potential damage of, the outer conductor 116, for example, from fraying, from exposure to the atmosphere, and/or from being electrically contacted.

In some embodiments, the inner conductor 112 can be operable to carry an electrical signal, and the outer conductor 116 can operable to be grounded. In embodiments where the inner conductor 112 carries a radio-frequency signal, such as a signal with a frequency of between approximately 2 and 300 GHz, it can be desirable to minimize series inductance and/or shunt capacitance, which can be induced if the dielectric 114 extends beyond the outer conductor 116 at the end of the cable. Accordingly, the outer conductor 116 and the dielectric 114 can be flush or substantially flush. Similarly stated, in some embodiments described herein the outer conductor 116 can terminate at an axial location that coincides with, or is slightly offset from, the axial location at which the dielectric 114 terminates.

The cable 110 can be operable to be coupled to a PCB 140. For example, the inner conductor 112 can be operable to be electrically coupled to a terminal of the PCB 140, such that the PCB 140 can receive the signal carried by the inner conductor 112. Similarly, the outer conductor 116 can be electrically operable to be coupled to a ground plane of the PCB 140.

The outer conductor 116 can be susceptible to fraying when the cable 110 is cut, which can negatively impact the impedance of the cable 110 and/or cause a portion of the dielectric 114 to protrude beyond the outer conductor 116. Accordingly, the clamp 120 can be can be coupled to the outer conductor 116 to prevent the outer conductor 116 from fraying. Moreover, the clamp 120 can be operable to not affect, or not substantially affect the impedance of the cable 110.

The clamp 120 can have a body and one or more projections. The body of the clamp can hold the outer conductor 116 in place and/or prevent the outer conductor 116 from fraying. The projections can be received by one or more corresponding openings on the PCB 140, such that the clamp 120 can fixedly couple the cable 110 to the PCB 140. In some embodiments, the clamp 120 can further include one or more crimping portions, which can be crimped to a portion of the cable 110, for example, the outer conductor 116 and/or the sheath.

In some embodiments, the cable 110 can be cut, for example, from a bulk spool of cable, before the cable 110 is coupled to the PCB 140. In such an embodiment, the cable 110 can be prepared by stripping a portion of the outer conductor 116 and the dielectric 114 to expose an axial length of the inner conductor 112. For example, the cable 110 can be cut so that the outer conductor 116 and the dielectric 114 are flush or are substantially flush. The cable 110 can be positioned on the PCB 140, such that the inner conductor 112 is proximate to the terminal of the PCB 140 and at least a portion of the outer conductor 116 is proximate to the ground plane of the PCB 140. The clamp 120 can be placed over the cable 110 such that the cable 110 is secured to the PCB 140. For example, the projections of the clamp 120 can be inserted into the openings of the PCB 140, such that the clamp 120 is coupled to the outer conductor 116 and to the PCB 140. Once placed, the clamp 120 can hold the cable 110 in position relative to the PCB 140 and/or to prevent the outer conductor 116 from fraying. For example, the clamp 120 can be crimped to the cable 110 near the end of the outer conductor 116, such that the outer conductor 116 is secured from fraying. The clamp 120 can also be fixedly coupled to the PCB 140. For example, the clamp 120 can be soldered, pinned, crimped, press fit, and/or coupled to the PCB 140 by any other suitable means. In some embodiments, the clamp 120 can electrically couple the outer conductor 116 to the ground plane of the PCB 140. In some embodiments, the clamp 120 can secure the cable 110 to the PCB 140 without affecting or without substantially affecting the impedance of the cable 110.

In other embodiments, an end portion of the cable 110 can be prepared by stripping a portion of the outer conductor 116 and the dielectric 114 to expose an axial length of the inner conductor 112 some time before the cable 110 is coupled to the PCB 140. For example, a supplier of the cable 110 can prepare and ship pre-cut lengths of cable 110 to a consumer (e.g., to a person or entity for coupling to the PCB 140). In such an embodiment, the clamp 120 can be fixedly coupled to the cable 110 before the cable is shipped. For example, after the cable 110 is prepared, the clamp 120 can crimped, soldered, and/or fixedly coupled to the cable 110 by any other suitable means to prevent the outer conductor 116 from fraying, for example, in transit. The consumer, upon receiving the cable 110 and the clamp 120 can insert the projections of the clamp 120 into the openings of the PCB 140 such that the inner conductor 112 is proximate to the terminal of the PCB 140. In some such embodiments, the cable 110 can be cut before shipment and/or before use such that the outer conductor 116 and the dielectric 114 are flush or substantially flush.

The inner conductor 112 and/or the clamp 120 can be fixedly coupled to the PCB 140 by any suitable means. For example, the inner conductor 112 can be soldered to the terminal and/or inserted into a connector of the PCB 140. Similarly, the outer conductor 114 can be coupled to the ground plane of the PCB 140 by any suitable means. For example a portion of the outer conductor 114 can be soldered to the ground plane of the PCB 140. In some embodiments, the clamp 120 can electrically couple the outer conductor 114 to the ground plane of the PCB 140. For example, the clamp 120 can be conductive and can be electrically coupled to both the outer conductor 114, and the ground plane of the PCB 140. For example, the body of the clamp 120 can be in electrical contact with the outer conductor 114, while the projections of the clamp 120 can be in electrical contact with the ground plane of the PCB 140.

In some embodiments, the impedance of the cable 110 and/or the impedance of the cable 110 connected to the PCB 140 is not substantially affected by the clamp 120. For example, the clamp 120 can allow the cable 110 and/or the junction between the cable 110 and the PCB 140 to be tuned with fewer constraints than traditional methods. For example, traditional methods may use particular geometries, such as circuitous signal paths and/or a portion of dielectric extending beyond an outer conductor. Thus, voltage standing wave ratio (VSWR) and/or the mismatch loss (ML) of the cable 110 coupled to the PCB 140 with the claim 120 can be significantly less than would traditionally be achievable, using, for example, low-cost connectors, such a U.FL connector. For example, traditional methods of coupling a cable to a PCB could result in a VSWR of approximately 2, and a ML of approximately 0.5. Some embodiments described herein can have a VSWR of less than 2, less than 1.7, less than 1.5, or less than 1.4. Similarly, some embodiments described herein can have a ML of less than 0.5, less than 0.3, less than 0.2, or less than 0.15.

Figure 2B:
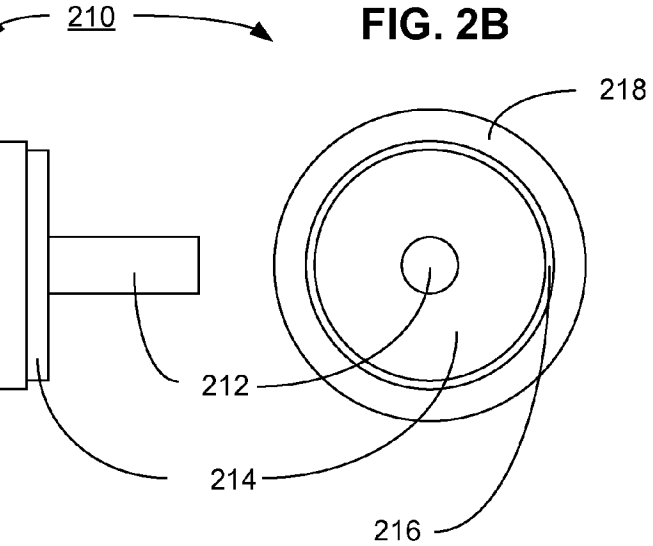
FIGS. 2A and 2B are an axial and a radial view of a cable, respectively, according to an embodiment.
Figure 2A:
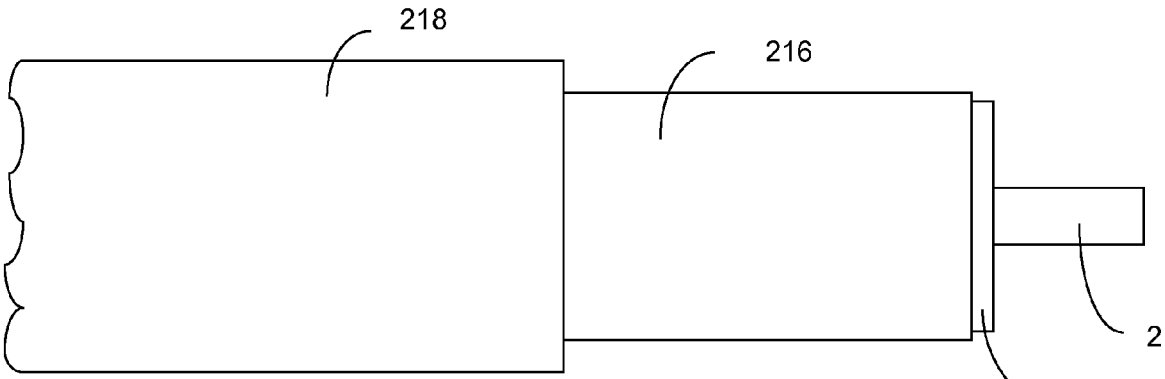

FIGS. 2A and 2B are an axial and a radial view of a cable 210, respectively, according to an embodiment. The cable 210 can be functionally and/or structurally similar to the cable 110 as shown and described above with reference to FIG. 1. The cable 210 includes an inner conductor 212, a dielectric 214, an outer conductor 216, and a sheath 218. The inner conductor 212, the dielectric 214, and the outer conductor 216 can each be structurally and/or functionally similar to the inner conductor 112, the dielectric 114, and the outer conductor 116, respectively, as shown and described above with reference to FIG. 1. The sheath 218 can surround the outer conductor 216. The sheath 218 can be constructed of polyvinyl chloride, cotton, or any other suitable material, such as a plastic and/or a natural fiber membrane. The sheath 218 can protect, or reduce potential damage of, the outer conductor 216, for example, from fraying, from exposure to the atmosphere, and/or from being electrically contacted.

As shown in FIG. 2A, the cable 210 can be prepared to be coupled to a PCB. A portion of the sheath 218 can be removed, exposing a portion of the outer conductor 216. The exposed portion of the outer conductor 216 can be operable to be electrically coupled to a ground plane of a PCB. A portion of the outer conductor 216 and a portion of the dielectric 214 can be removed exposing a portion of the inner conductor 212. The exposed portion of the inner conductor 212 can be operable to be electrically coupled to a terminal of a PCB.

The length of exposed outer conductor 216 can be selected such that a clamp can be coupled to the outer conductor 216, as discussed in further detail herein. As shown, a portion of dielectric 214 extends beyond the outer conductor 216. Extending the dielectric 214 beyond the outer conductor 216 can reduce the opportunity of bridging between the inner conductor 212 and the outer conductor 216. Extending the dielectric 214 beyond the outer conductor 216, however, can also negatively affect the high-frequency bandwidth of the cable, for example, altering the impedance of the cable 210 by introducing series inductance and/or shunt capacitance. Accordingly, in some embodiments described herein, the length of dielectric 214 extending beyond the outer conductor 216 is minimized or eliminated. For example, in some embodiments, the outer conductor 216 and the dielectric 214 are flush or substantially flush; in other embodiments, the dielectric 214 can extend beyond the outer conductor 216 less than approximately 1 mm, less than approximately 3 mm, less than approximately 5 mm, or less than approximately 10 mm.

Figure 3:
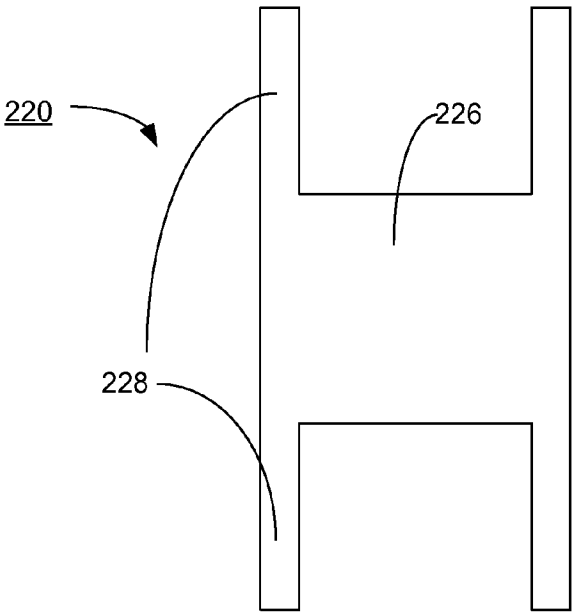
FIG. 3 is a top view of a clamp, according to an embodiment.

FIG. 3 is a top view of a clamp 220, according to an embodiment. The clamp 220 can be configured to be coupled to a cable, such as the cable 210 of FIGS. 2A and 2B. As shown, the clamp 220 includes a body portion 226 and four protrusions 228. The body 226 can be operable to be coupled to the sheath 216 of cable 210. The protrusions 228 can be configured to be inserted into openings of a PCB, for example to fixedly couple the cable 210 to the PCB.

As shown, the clamp 210 is substantially planar. For example, the clamp 210 can be stamped from sheet metal stock. The clamp 210 can be configured to be bent, crimped, and/or otherwise formed about the cable 210, for example, to prevent the outer conductor 216 from fraying and/or to couple the cable 210 to the PCB.

In some embodiments, the cable 210 can be configured such that the clamp 220 can be disposed about an exposed portion of the outer conductor 216. For example, the length of the exposed outer conductor 216 can be similar to the length of the body 226 of the clamp 220. For example, in some embodiments, the length of the exposed portion of the outer conductor 216 can be within approximately 5% of the length of the body 226 of the clamp 220. In other embodiments, the length of the exposed portion of the outer conductor 216 can be within approximately 1% of the length of the body 226 of the clamp 220, within approximately 10% of the length of the body 226 of the clamp 220, or within approximately 25% of the length of the body 226 of the clamp 220. In some embodiments, the body of the clamp 226 can be approximately 3 cm long, approximately 5 cm long, approximately 10 cm long, or any other suitable size.

Figure 4:
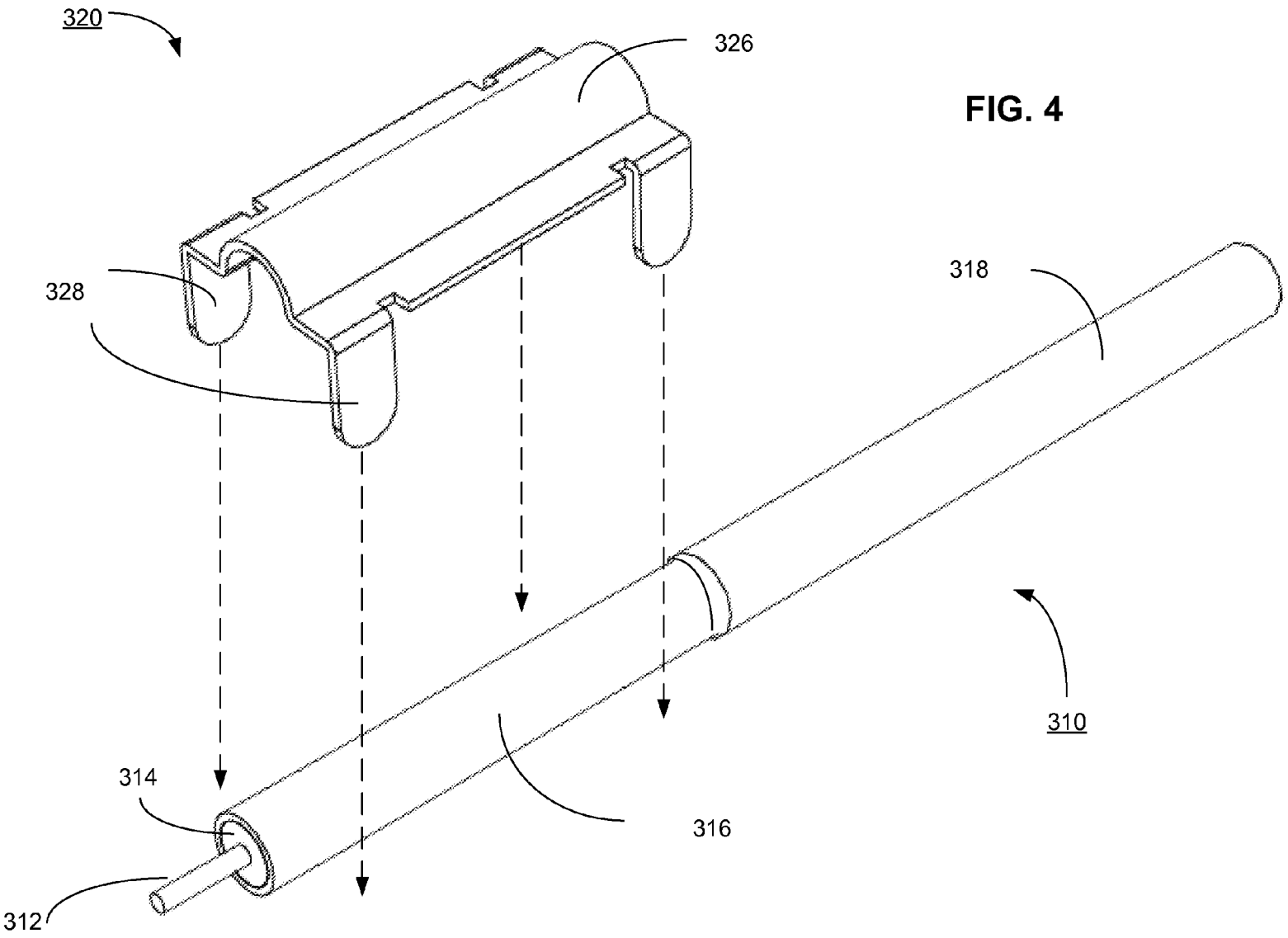
FIG. 4 is an isometric view of a cable and a clamp, according to an embodiment.

FIG. 4 is an isometric view of a cable 310 and a clamp 320, according to an embodiment. The cable 310 can be structurally and/or functionally similar to the cables 110 and 210 as shown and described above with reference to FIGS. 1, 2A, and 2B. The clamp 320 can be functionally similar to the clamps 120 and 220 as shown and described above with reference to FIGS. 1 and 3.

The cable 310 includes an inner conductor 312, a dielectric 314, an outer conductor 316, and a sheath 318. As shown, the cable 310 is prepared such that the dielectric 314 and the outer conductor 316 are cut flush, exposing an axial length of the inner conductor 312. Similarly stated, an axial length of the inner conductor 312 extends beyond the dielectric 314 and the outer conductor 316, which are even with each other. A portion of the sheath 318 is removed, exposing an axial length of the outer conductor 316.

The clamp 320, includes a body 326 and four protrusions 328. The body 326 of the clamp 320 has a semi-cylindrical shape, corresponding to the shape of the cable 310. The clamp 320 can be operable to couple to the cable 310, for example, to prevent the outer conductor 316 from fraying.

The clamp 320 can be similar to the clamp 220 of FIG. 3. The clamp 320 can be first stamped and/or cut from substantially flat sheet metal stock, and then shaped, bent, stamped, and/or crimped such that the body portion 326 has a semi-cylindrical shape.

Figure 5:
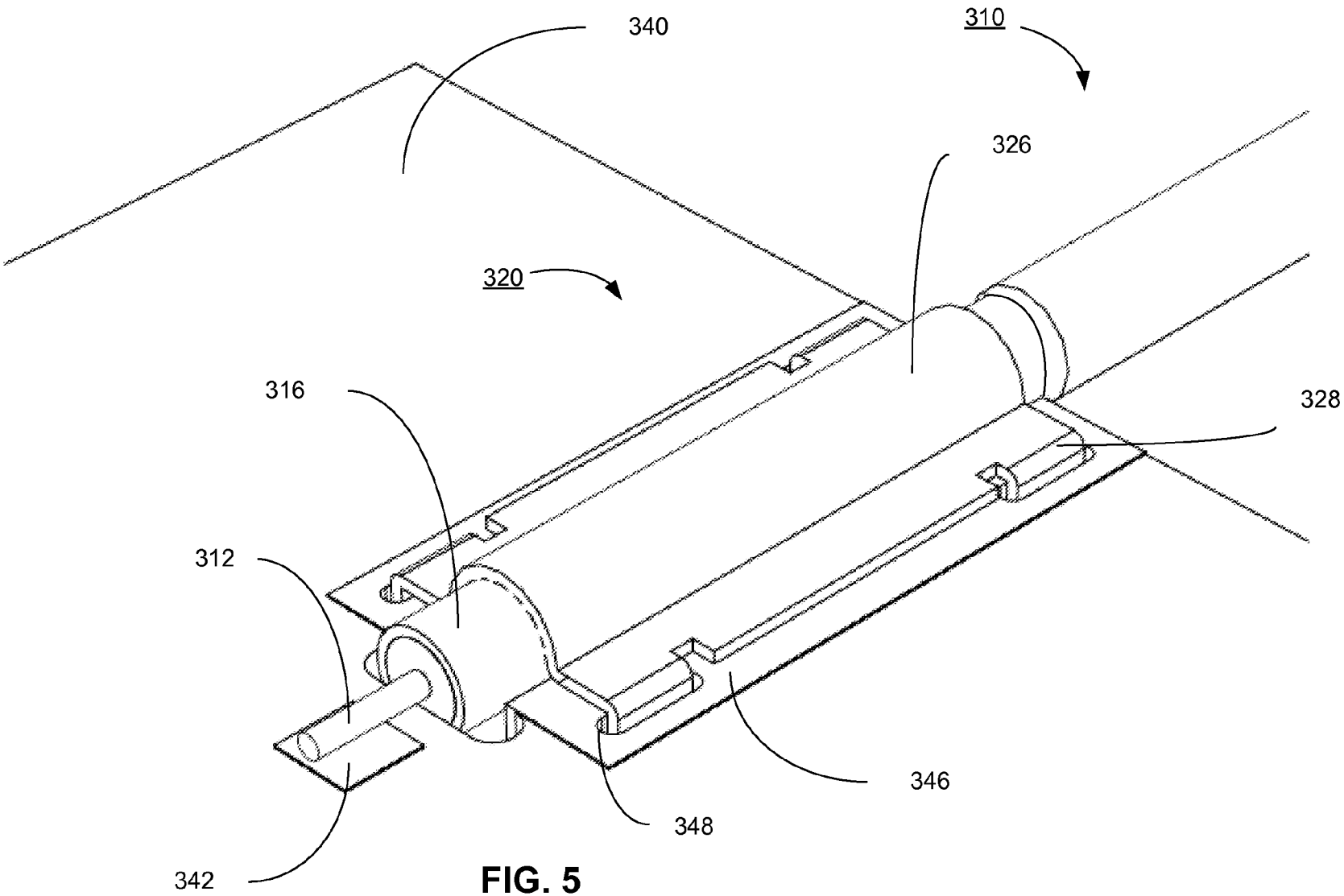
FIG. 5 is an isometric view of the cable, the clamp, and the PCB, of FIG. 4.

FIG. 5 is an isometric view of the cable 310 and the clamp 320 of FIG. 4 coupled to a PCB 340. The PCB 340 can be functionally and/or structurally similar to the PCB 140, as shown and described with respect to FIG. 1. The PCB 340 includes a terminal 342, a ground plane 346, and four openings 348.

The PCB 340 is operable to receive the cable 310 and the clamp 320. The terminal 342 is operable to be coupled to, and/or receive an electrical signal from, the inner conductor 312. Similarly, the ground plane 345 is operable to be electrically coupled to the sheath 316.

The openings 348 of the PCB 340 are operable to receive the protrusions 328 of the clamp 320. In some embodiments, the openings 328 can be operable to position the cable 310 on the PCB 340, such that the inner conductor 312 is positioned proximate to the terminal 342 (e.g., in contact with, directly over, and/or within a distance such that the inner conductor 312 can be coupled to the PCB 340). As shown, the body 326 of the clamp is operable to electrically couple the sheath 316 to the ground plane 346.

In some embodiments, the inner conductor 312 can be soldered and/or otherwise fixedly coupled to the terminal 342. Similarly, the clamp 320 can be soldered and/or otherwise fixedly coupled to the ground plane 346. For example, in some embodiments, the protrusions 328 of the clamp 320 can be bent, crimped, press-fit, and/or otherwise secured within the openings 348 of the PCB 340, such that at least a portion the clamp 320 is mechanically and/or electrically fixedly coupled to the ground plane 346. When the clamp 320 is coupled to the PCB 340, a force can be exerted on the cable 310, such that the cable 310 remains fixedly coupled to the PCB 340.

Figures 6, 7:
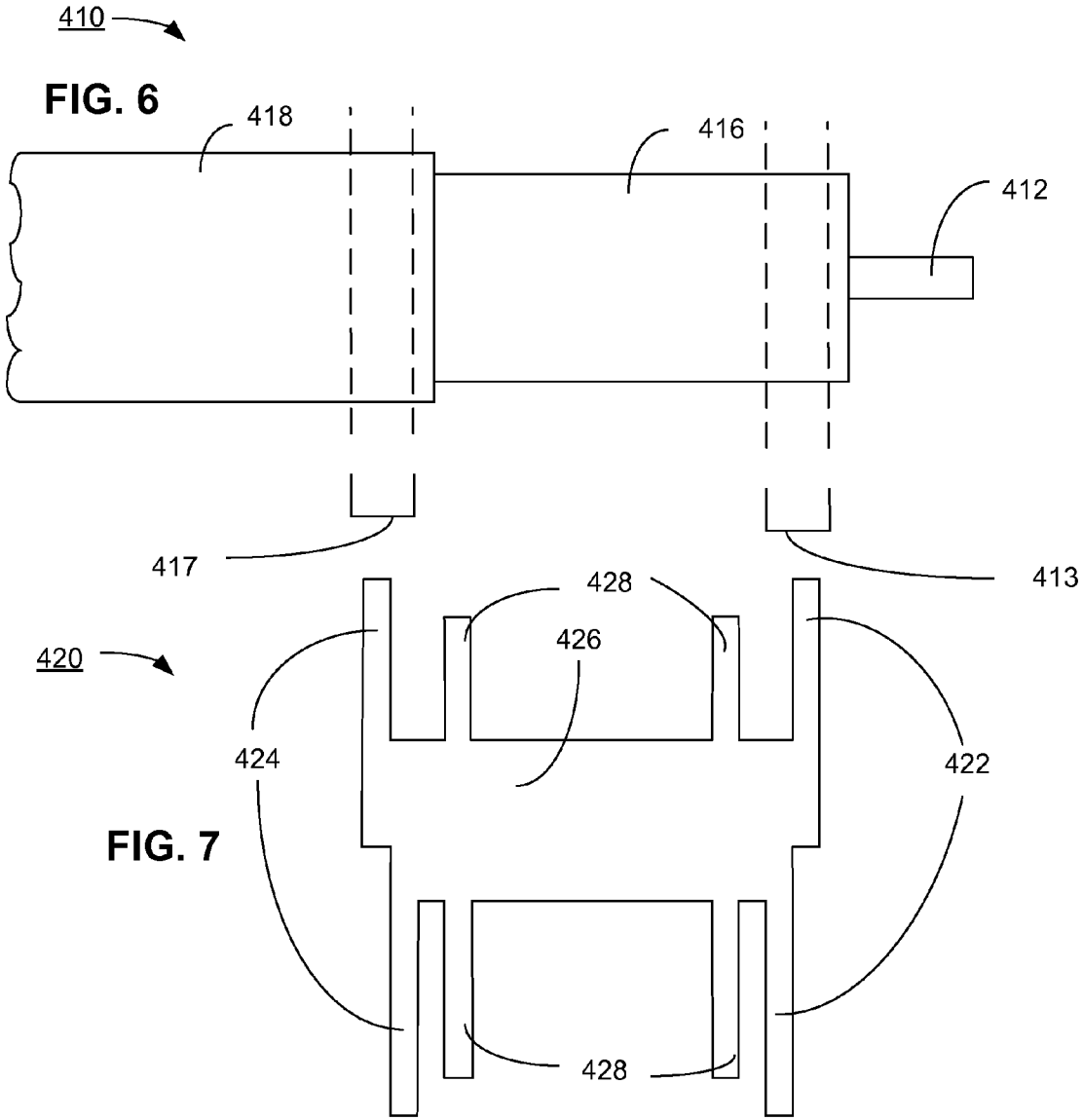
FIG. 6 is a top view of a cable, according to an embodiment.
FIG. 7 is a top view of a clamp, according to an embodiment.

FIGS. 6 and 7 are top views of a cable 410 and a clamp 420, respectively, according to an embodiment. The cable 410 includes a sheath 418, an outer conductor 416, and an inner conductor 412. The cable 410 can further include a dielectric (not shown in FIG. 6) disposed between the inner conductor 412 and outer conductor 416. The cable 410, sheath 418, outer conductor 416, and inner conductor 412 can be structurally and/or functionally similar to the cables, sheathes, outer conductors, and/or inner connectors, respectively, described above with reference to FIGS. 1-5. As shown, the dielectric does not extend beyond the outer conductor 416. The cable 410 includes a first portion 413 and a second portion 417. The first portion 413 of the cable 410 can be located proximate to the end of the outer conductor 416 and/or cable 410. The first portion 413 of the cable 410 is disposed between the second portion 417 of the cable 410 and the end of the cable 410.

The clamp 420 can be functionally similar to the clamps described above with reference to FIGS. 1-5. The clamp 420 is substantially planar and includes a first crimping portion 422, a second crimping portion 424, a body 426, and four projections 428. The body 426 and the projections 428 can be structurally and/or functionally similar to the bodies and the projections of the clamps described above with reference to FIGS. 1-5.

The first crimping portion 422 can be operable to be disposed about the first portion 413 of the cable 410. The first portion 413 of the cable 410 can include a portion of the outer conductor 416 susceptible to fraying (e.g., the first portion 413 of the cable 410 can be an axial portion of the cable 410 where the outer conductor 416 is the outermost portion of the cable 410). When the first crimping portion 422 is disposed about the first portion 413 of the cable 410, fraying of the outer conductor 416 can be eliminated or reduced. The first portion 413 of the cable 410 can include a portion of the exposed outer conductor 416 adjacent to the exposed inner conductor 412. For example, the first portion 413 of the cable 410 can be less than 3 mm from the end of the outer conductor 416, less than 1 cm from the end of the outer conductor 416, less than 5 cm from the end of the outer conductor 416, or any other suitable length from the end of the outer conductor 416. The first crimping portion 422, when disposed about the first portion 413 of the cable 410, can thereby secure the outer conductor 416 and prevent fraying.

The first crimping portion 422 can have a length similar to or greater than the circumference of the first portion 413 of the cable 410 such that when the first crimping portion 422 is disposed about the first portion 413 of the cable 410, the first crimping portion 422 surrounds the first portion 413 of the cable 410. As shown, the first crimping portion 422 includes two crimping tines slightly offset from each other, such that the first crimping portion 422 can be disposed circumferentially around the first portion 413 of the cable 410 without the tines interfering with each other. Similarly stated, the first crimping portion 422 can extend circumferentially around the first portion 413 of the cable 410 in excess of 360 degrees.

The length of first crimping portion 422 can be, for example, approximately 3.5 mm, approximately 8.2 mm, approximately 18.2 mm, and/or any other suitable size. In some embodiments, the length of the protrusions 418 can be similar to the thickness of a PCB. For example, the crimping portions 422 can have a length of approximately 1.6 mm, approximately 3.2 mm, approximately 4.8 mm, and or any other suitable length. In some embodiments, the length of the first crimping potion 422 can be greater than the length of the protrusions 428.

The second crimping portion 424 can be similar to the first crimping portion 422. The second crimping 424 portion can be operable to be disposed circumferentially about the second portion 417 of the cable 410. The second portion 417 of the cable 410 can include a portion of the sheath 418 (e.g., the second portion 417 of the cable 410 can be an axial portion of the cable 410 where the sheath 418 is the outermost portion of the cable 410). The second portion 417 of the cable 410 can be located proximate to the end of the sheath 418. Similarly stated, the second portion 417 of the cable 410 can include a portion of the sheath 418 less than 1 cm from the end of the sheath 418, less than 5 cm from the end of the sheath 418, or any other suitable length from the end of the sheath 418. In other embodiments, the second portion 417 of the cable 410 can include a portion of the outer conductor 416 (e.g., the second portion 417 of the cable 410 can be an axial portion of the cable 410 where the outer conductor 416 is the outermost portion of the cable 410).

The length of the second crimping portion 242 can be similar to or greater than the circumference of the second portion of the cable 417. In some embodiments, the length of the second crimping portion 242 can be the same as or similar to the length of the first crimping portion 422. In other embodiments, the length of the second crimping portion 424 can be greater or lesser than the first crimping portion 422. In some embodiments the length of the second crimping portion 422 can be greater than the length of the protrusions 428.

In some embodiments, the clamp 420 can be configured to be disposed about the cable 410 during or shortly after assembly, and before the cable 410 is coupled to a PCB. For example, the clamp 420 can be disposed about the cable 410 at a facility of a cable producer to prevent the outer conductor 416 from fraying in transit to a consumer. Additionally, in some embodiments, the cable 410 with clamp 420 attached can reduce or eliminate a user of the cable 410 preparing the cable (e.g., stripping, soldering, preparing a connector, etc.) prior to coupling the cable 410 to a PCB.

Figure 8A:
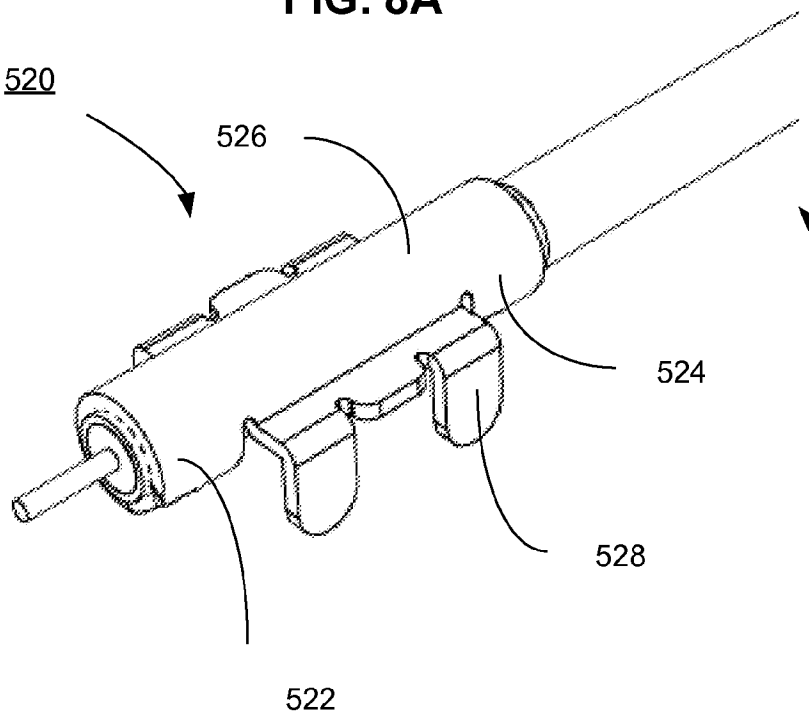
FIGS. 8A and 8B are an isometric view and a bottom view, respectively, of a clamp disposed about a cable, according to an embodiment.
Figure 8B:
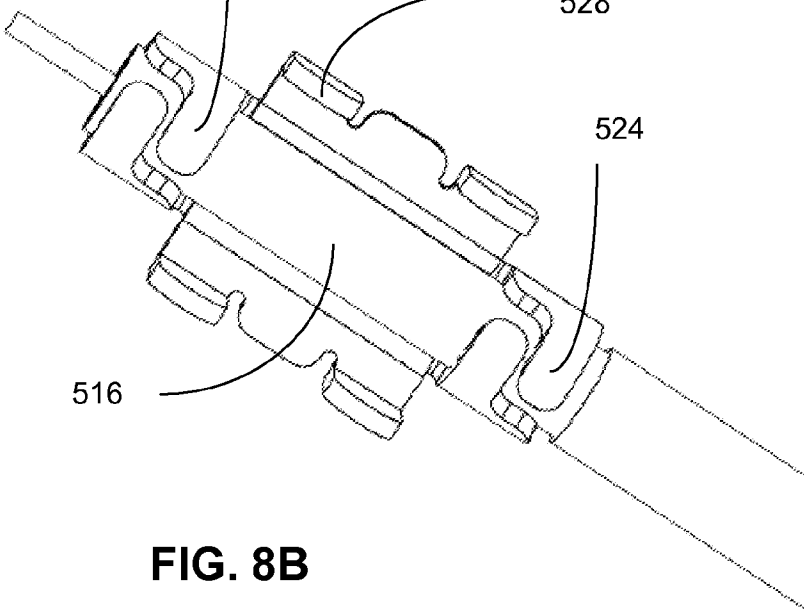

FIGS. 8A and 8B are an isometric view and a bottom view, respectively, of a clamp 520 disposed about a cable 510, according to an embodiment. The clamp 520 can be structurally and/or functionally similar to the clamp 420 as shown and described above with reference to FIG. 7. The cable 510 can be structurally and/or functionally similar to any of the cables described above with reference to FIGS. 1-6.

The clamp 520 includes a first crimping portion 522, a second crimping portion 524, a body 526, and four protrusions 528. The first crimping portion 522 substantially surrounds a first portion of the cable 510, while the second crimping portion 524 substantially surrounds a second portion of the cable 510. The first crimping portion 522 is disposed around and in contact with a portion of the outer conductor 516 and is located proximate to the end of the cable 510. By surrounding the outer conductor 516 near the end of the cable 510, the first crimping portion 522 can prevent the outer conductor 516 from fraying.

The body 526 of the clamp 520 can be electrically coupled to the outer conductor 516 and can electrically couple the outer conductor 516 to a ground plane of a PCB. The protrusions 528 can be disposed in openings of a PCB to position the cable, and/or to mechanically and/or electrically couple the clamp 520 to the PCB.

The clamp 520 can be substantially planar before being crimped to the cable. For example, the clamp 520 can be similar to the clamp 420 as shown and described above with respect to FIG. 7. A crimping tool can be used to bend the first crimping portion 522, the second crimping portion 524, and/or the body 526 about the cable 510, such that, when disposed about the cable 510, the first crimping portion 522, the second crimping portion 524, and/or the body 526 are substantially circular, semi-circular, cylindrical, semi-cylindrical, and/or disposed circumferentially about portions of the cable 510. In some embodiments, the protrusions 528 can remain substantially planar. In some embodiments, the crimping tool and/or some other suitable tool can bend the protrusions 528, for example, ninety degrees, such that the protrusions are operable to be disposed within an opening of a PCB, for example, as shown in FIGS. 8A and 8B. In other embodiments, the clamp 520 can be configured such that the substantially planar protrusions 528 extend tangentially from a circular, semi-circular, and/or cylindrical portion of the body 526 after the body 526 is crimped about the cable 510.

Figure 9A:
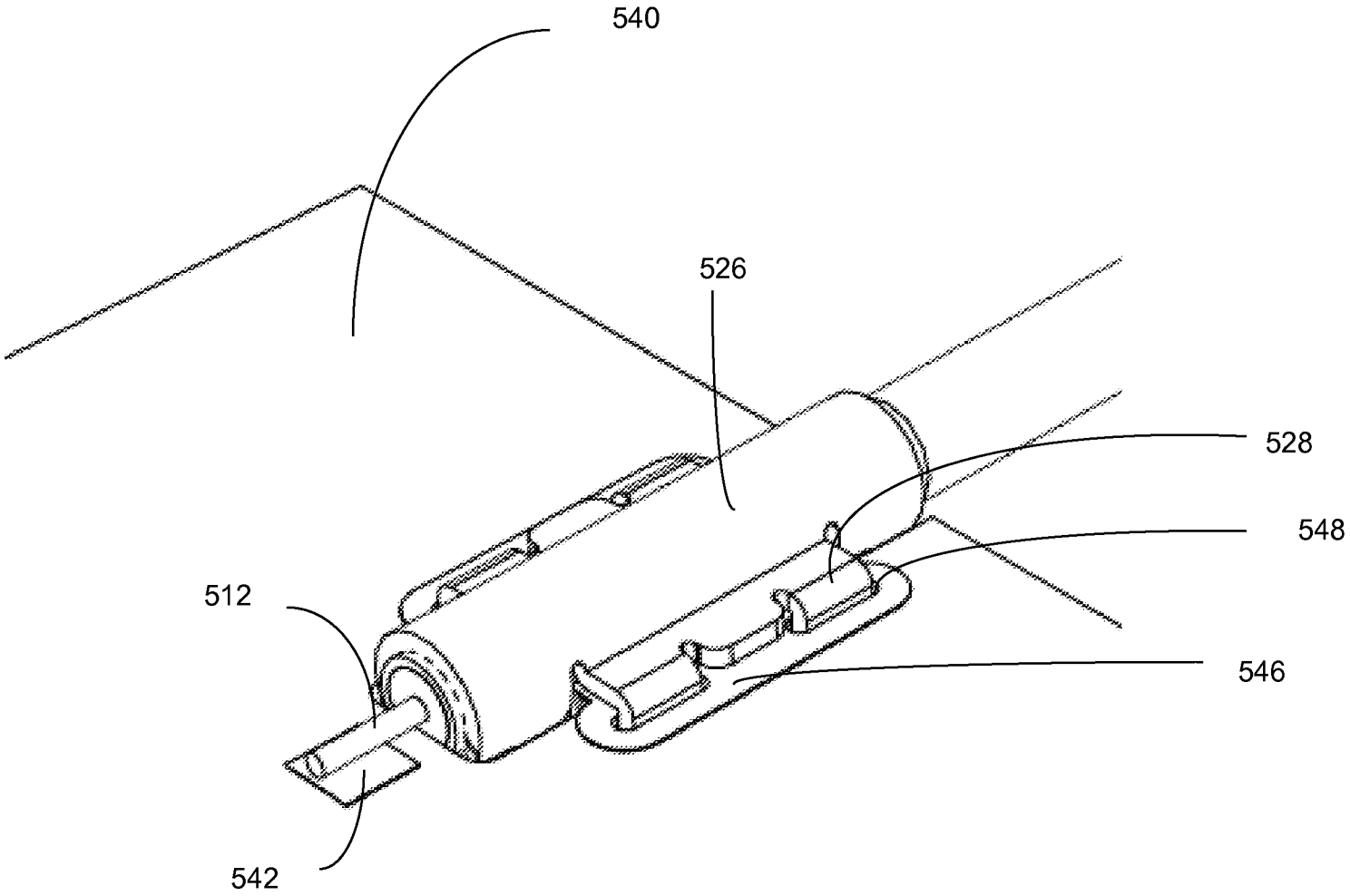
FIGS. 9A and 9B are an isometric view and a bottom view, respectively, of the cable, the clamp, and the PCB of FIGS. 8A and 8B.
Figure 9B:
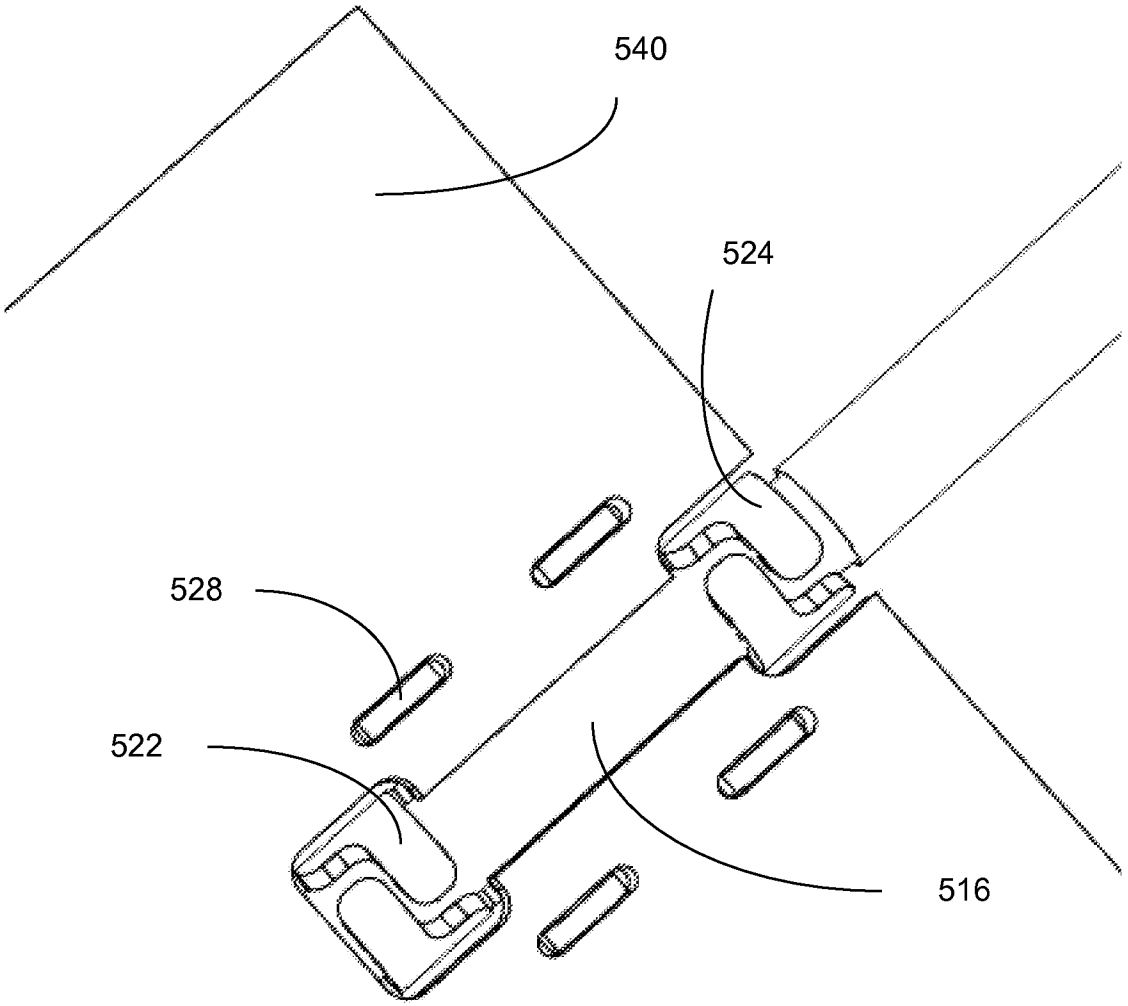

FIGS. 9A and 9B are an isometric view and a bottom view, respectively, of the cable 510 and the clamp 520 of FIGS. 8A and 8B coupled to a PCB 540. The PCB 540 includes a terminal 542, a ground plane 546, and openings 548, which can be functionally and/or structurally similar to the terminal 342, the ground plane 346, and/or the openings 348, as shown and described above with reference to FIG. 5. In some embodiments, the protrusions 528 can have a length sufficient to secure the clamp 520 to the PCB 540. The length of the protrusions 528 can be less than the length of the first crimping portion 522 and/or the second crimping portion 524.

The protrusions 528 and the openings 548 can be positioned relative to each other such that the inner conductor 512 is disposed proximate to the terminal 542 (e.g., in contact with, directly over, and/or within a distance such that the inner conductor 512 can be coupled to the terminal 542). The inner conductor 512 can be mechanically and/or electrically coupled to the terminal 542. For example, the inner conductor 512 can be soldered to the terminal. Similarly, the body 526 of the clamp can be operable to electrically couple the outer conductor 516 to the ground plane 546. For example, the outer conductor 516 can be electrically coupled to the ground plane via a portion of the body 526 and/or a portion of the protrusions 528. In some embodiments, a portion of the body 526 and/or a portion of the protrusions 528 can be soldered to the ground plane 548.

Figure 10:
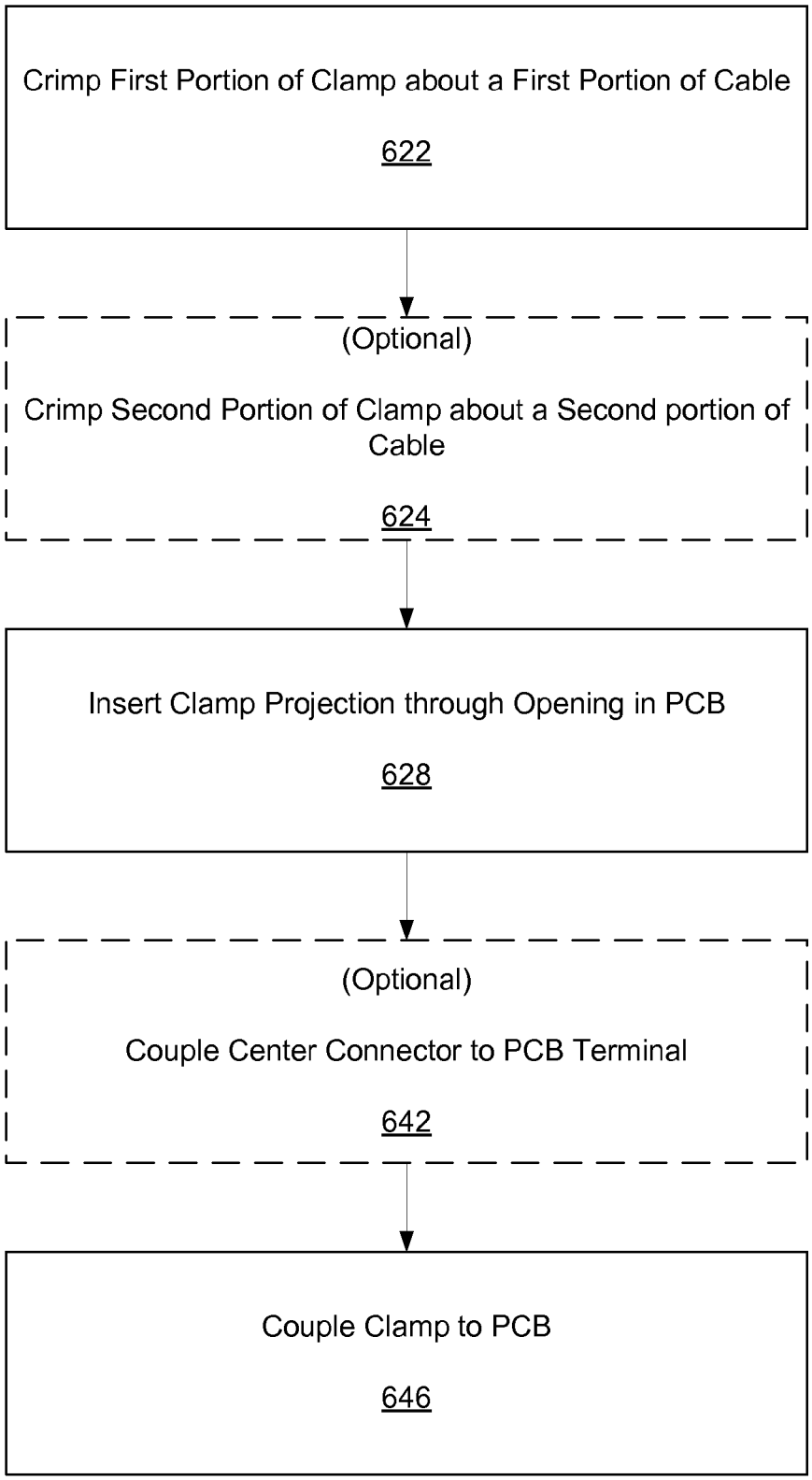
FIG. 10 is a flow chart of a method of coupling a cable to a PCB, according to an embodiment.

FIG. 10 is a flow chart of a method of coupling a cable to a PCB, according to an embodiment. The method can include crimping a first portion of a clamp about a first portion of a cable, at 622. The cable and/or the clamp can be structurally and/or functionally similar to the cables and/or clamps shown and described above with reference to FIGS. 1-9. For example, a first crimping portion of the clamp, can be crimped to a portion of an outer conductor, proximate to the end of the cable, as shown and described above with reference to FIGS. 6, 7, 8A, 8B, 9A, and 9B. Crimping the first portion of the clamp about the first portion of the cable, at 622, can be prevent an exposed portion of the outer conductor from fraying.

In some embodiments, a second portion of the clamp can be crimped about a second portion of the cable, at 624. For example, a second crimping portion of the clamp can be crimped about a portion of a sheath, for example, as shown and described above with reference to FIGS. 6 and 7, and/or the second portion of the clamp can be crimped about a second portion of the outer conductor, for example, as shown and described with reference to FIGS. 8A, 8B, 9A, and 9B.

In some embodiments, crimping the first portion of the clamp, at 622, and/or crimping the second portion of the clamp, at 624, can include configuring a body of the clamp to conform to the shape of the cable. For example, at least a portion of a substantially planar clamp (such as the clamps 220 and/or 420, as shown and described above with reference to FIGS. 3 and 7) can be deformed, into a circular, semi-circular, cylindrical, and/or semi-cylindrical clamp disposed about a portion of a cable.

At 628, a projection of the clamp can be inserted through an opening in a PCB. The PCB can be structurally and/or functionally similar to the PCBs as shown and described above with reference to FIGS. 1, 4, 5, 9A and/or 9B. Inserting the projection of the clamp through an opening in the PCB, at 628, can, in some embodiments, position the cable relative to the PCB such that an inner conductor of the cable can be electrically coupled to a terminal of the PCB and/or such that the outer conductor can be electrically coupled to a ground plane of the PCB.

In some embodiments, the inner conductor can be electrically and/or mechanically coupled to the PCB, at 642. For example, the inner conductor can be soldered, pinned, and/or clamped to a terminal. Similarly, the clamp can be electrically and/or mechanically coupled to the PCB, at 646. For example, in some embodiments, the clamp can be electrically coupled to the outer conductor and to the ground plane. The clamp can be soldered to the PCB and/or mechanically crimped, press fit, and/or coupled by any other suitable means.

While various embodiments have been described above, it should be understood that they have been presented by way of example only, and not limitation. For example, although some embodiments describe a clamp configured to be coupled to a PCB, in other embodiments, such a clamp can be coupled to any other structure operable to receive and/or position a cable, such as a chassis.

Although various embodiments have been described as having particular features and/or combinations of components, other embodiments are possible having a combination of any features and/or components from any of embodiments where appropriate. For example, although some embodiments of a clamp are described as having four projections operable to be disposed within four corresponding openings in a PCB, in other embodiments the clamp can have any number of projections, and the PCB can have any number of openings. For example, in some embodiments, the PCB can have more openings than the clamp has projections, such that the position of the clamp and/or the cable can be adjusted by positioning the projections in a particular opening or openings.

Where methods described above indicate certain events occurring in certain order, the ordering of certain events may be modified. Additionally, certain of the events may be performed repeatedly, concurrently in a parallel process when possible, as well as performed sequentially as described above. For example, with reference to FIG. 10, although an inner conductor is shown and described as being coupled to a PCB terminal, at 642, before a clamp is coupled to the PCB, at 646, in other embodiments, the clamp can be coupled to the PCB before the inner conductor is coupled to the terminal. Similarly the crimping of the first portion of the clamp, at 622 and the crimping of the second portion of the clamp, at 624 can occur in any order, and/or simultaneously.

What is claimed is:

1. An apparatus, comprising:

a cable clamp having a first portion and a second portion, the first portion of the cable clamp configured to be crimped about an end portion of a cable having an inner conductor, an outer conductor, and a dielectric portion that does not extend beyond the outer conductor, the second portion of the cable clamp configured to define a projection configured to be inserted into an opening of a printed circuit board, the cable clamp configured to be fixedly coupled to the printed circuit board after the second portion of the cable clamp is inserted into the opening of the printed circuit board.

2. The apparatus of claim 1, wherein:

the cable clamp has a third portion, the second portion of the cable clamp being disposed between the first portion of the cable clamp and the third portion of the cable clamp, the third portion of the cable clamp is configured to be crimped about a portion of the cable mutually exclusive from the end portion of the cable.

3. The apparatus of claim 1, wherein:

the cable clamp is substantially planar, the first portion of the cable clamp has a length substantially corresponding to a circumference of the cable, the length of the first portion of the cable clamp being greater than a length of the second portion of the cable clamp.

4. The apparatus of claim 1, wherein:

the first portion of the cable clamp is substantially planar before being crimped around the end portion of the cable, the first portion of the cable clamp configured to be cylindrical after being crimped around the end portion of the cable, the second portion of the cable clamp being planar.

5. The apparatus of claim 1, wherein:

the cable clamp includes a third portion configured to be crimped about a portion of the outer conductor mutually exclusive from the end portion of the cable, the cable clamp configured to be fixedly coupled to the printed circuit board such that the third portion of the cable clamp is electrically coupled to the printed circuit board.

6. The apparatus of claim 1, wherein:

the first portion of the cable clamp is configured to be crimped about the end portion of the cable such that the inner conductor of the cable is coupled to a portion of the printed circuit board and such that an impedance of the cable is not affected by the cable clamp.

7. A method, comprising:

crimping a first portion of a cable clamp about an end portion of a cable having an inner conductor and an outer conductor;

inserting a second portion of the cable clamp into an opening of a printed circuit board;

soldering the second portion of the cable clamp to a first portion of the printed circuit board after the second portion of the cable clamp is inserted into the opening of the printed circuit board; and soldering the inner conductor of the cable to a second portion of the printed circuit board, such that an impedance of the cable is not substantially affected by the cable clamp.

8. The method of claim 7, wherein:

the cable is configured to operate at least 2 GHz; and at least a portion of the printed circuit board is configured to operate at least 2 GHz.

9. The method of claim 7, wherein the crimping includes crimping the first portion of the cable clamp about the end portion of the cable such that a dielectric portion of the cable does not extend substantially beyond the outer conductor of the cable.

10. The method of claim 7, further comprising:

crimping a third portion of the cable clamp about a portion of the cable mutually exclusive from the end portion of the cable before the inserting and the coupling, the second portion of the cable clamp being disposed between the first portion of the cable clamp and the third portion of the cable clamp.

11. The method of claim 7, wherein:

the cable clamp is substantially planar, the first portion of the cable clamp has a length substantially corresponding to a circumference of the cable, the length of the first portion of the cable clamp being greater than a length of the second portion of the cable clamp.

12. The method of claim 7, wherein:

the first portion of the cable clamp is substantially planar at a first time, the first portion of the cable clamp being crimped around the end portion of the cable into a cylindrical shape at a second time after the first time, the second portion of the cable clamp being planar.

13. The method of claim 7, wherein the end portion of the cable includes a portion of the outer conductor of the cable, the method further comprising:

crimping a third portion of the cable clamp about a portion of the outer conductor of the cable mutually exclusive from the end portion of the cable, the coupling including soldering at least one of the first portion of the cable clamp, the second portion of the cable clamp, or the third portion of the cable clamp to the printed circuit board.

14. An assembly, comprising:

a cable having an inner conductor and an outer conductor;

a printed circuit board having an opening, the inner conductor of the cable coupled to a terminal of the printed circuit board; and a cable clamp having a first portion and a second portion, the first portion of the cable clamp being crimped about an end portion of the outer conductor, the second portion of the cable clamp being disposed within the opening of the printed circuit board, the cable clamp being fixedly coupled to the printed circuit board, an impedance of the cable not being substantially affected by the cable clamp.

15. The assembly of claim 14, wherein the first portion of the cable clamp is configured to be crimped about the end portion of outer conductor such that a dielectric portion of the cable does not extend substantially beyond the end portion of the outer conductor.

16. The assembly of claim 14, wherein:

the end portion of the outer conductor is a first portion of the cable, the cable clamp has a third portion, the second portion of the cable clamp being disposed between the first portion of the cable clamp and the third portion of the cable clamp, the third portion of the cable clamp is configured to be crimped about a portion of the cable mutually exclusive from the end portion of the cable.

17. The assembly of claim 14, wherein:

the cable clamp includes a third portion configured to be crimped about a circumferential portion of the outer conductor mutually exclusive from the end portion of the cable, the cable clamp configured to be soldered to the printed circuit board such that the third portion of the cable clamp is electrically coupled to the printed circuit board.

* * * * *